US005533228A

United States Patent [19]

Jarecki et al.

[11] Patent Number: 5,533,228

[45] Date of Patent: Jul. 9, 1996

[54] RESEALBLE PAINT TRAY

[75] Inventors: James J. Jarecki; Bruce C. Polzin, both of Greendale, Wis.

[73] Assignee: Newell Operating Company, Freeport, Ill.

[21] Appl. No.: 298,022

[22] Filed: Aug. 29, 1994

[51] Int. Cl.[6] ..... B05C 21/00; B65D 43/03

[52] U.S. Cl. ..... 15/257.06; 206/518; 220/306; 220/337; 220/570

[58] Field of Search ..... 15/257.06; 220/306, 220/337, 338, 570, 380; 206/518, 519, 515

[56] References Cited

U.S. PATENT DOCUMENTS

| | | | |
|---|---|---|---|
| 1,239,223 | 9/1917 | Ross | 220/306 |
| 1,918,987 | 7/1933 | Seabold, Jr. | 220/306 |
| 2,661,858 | 12/1953 | Howell | 220/570 |
| 3,077,284 | 2/1963 | McLaughlin | 220/306 |
| 3,828,389 | 8/1974 | Heisler | 15/257.06 |
| 4,431,114 | 2/1984 | Kleinfeld | 220/337 |
| 4,445,250 | 5/1984 | Seidl | 15/257.06 |
| 4,547,926 | 10/1985 | Kern | 15/257.06 |
| 4,815,604 | 3/1989 | O'Neil | 220/570 |
| 4,872,586 | 10/1989 | Landis | 220/380 |
| 4,890,353 | 1/1990 | Shannon | 15/257.06 |
| 5,377,861 | 1/1995 | Landis | 220/380 |

FOREIGN PATENT DOCUMENTS

| | | | |
|---|---|---|---|
| 0124305 | 11/1984 | European Pat. Off. | 220/380 |
| 2376034 | 7/1978 | France | 220/306 |
| 2511975 | 3/1983 | France | 220/306 |
| 2630085 | 10/1989 | France | 220/306 |
| 2240322 | 7/1991 | United Kingdom | 220/306 |

*Primary Examiner*—David Scherbel
*Assistant Examiner*—Randall E. Chin
*Attorney, Agent, or Firm*—Baker & McKenzie

[57] ABSTRACT

A resealable paint tray assembly composed of a lid and tray formed as separate components and means for locking the lid to the tray to prevent skin forming on paint left for extended periods in the tray, the tray having a smooth uninterrupted inside and outside surface, the tray assembly having a brush rest section usable only when the tray assembly is open and in use.

13 Claims, 2 Drawing Sheets

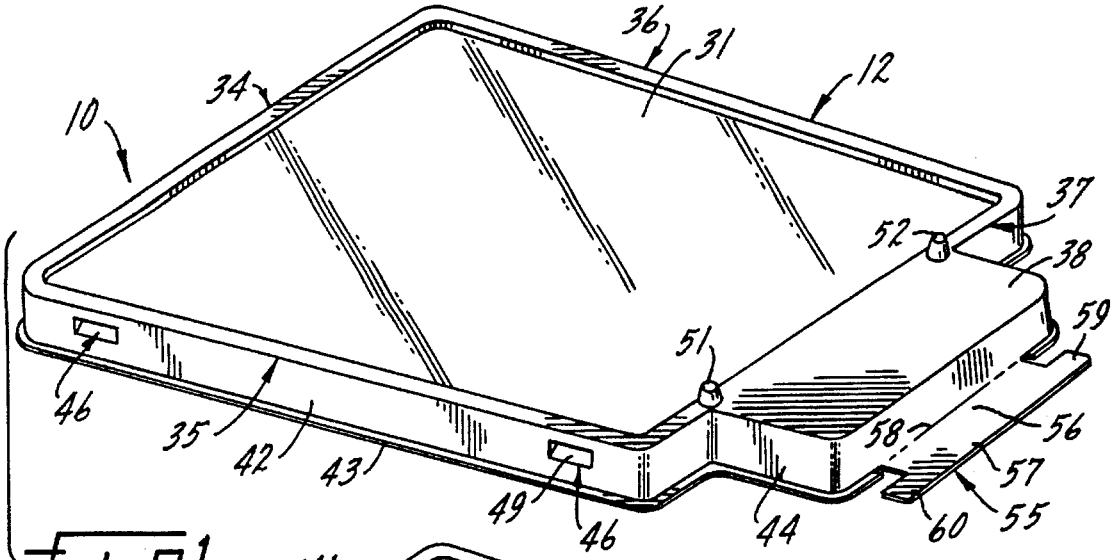
Fig.1.
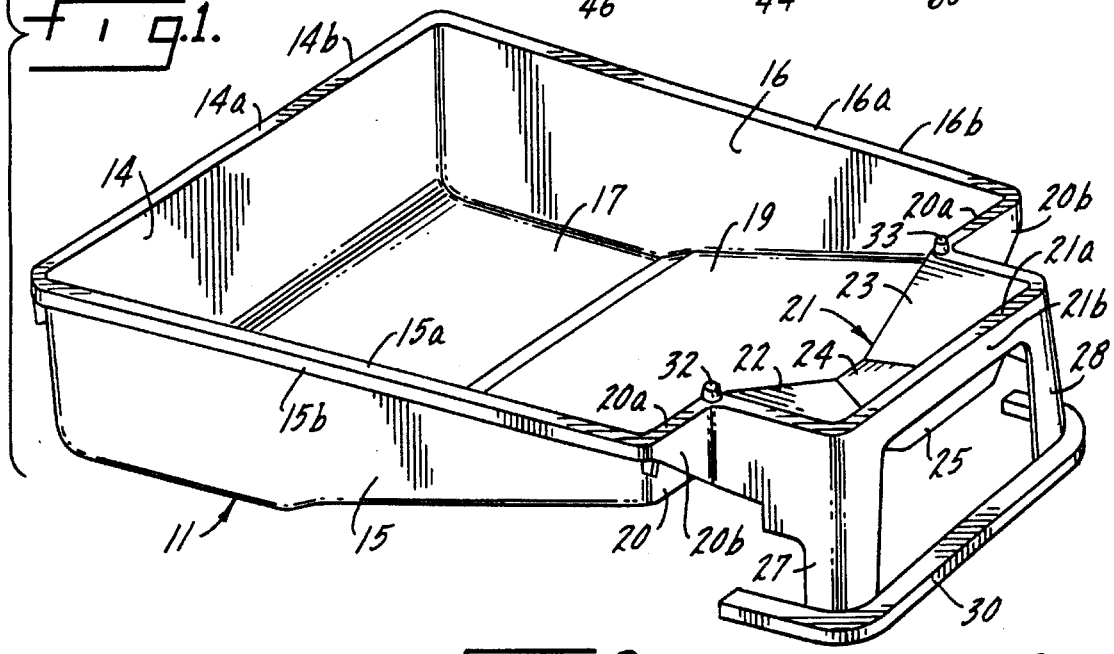
Fig.2.
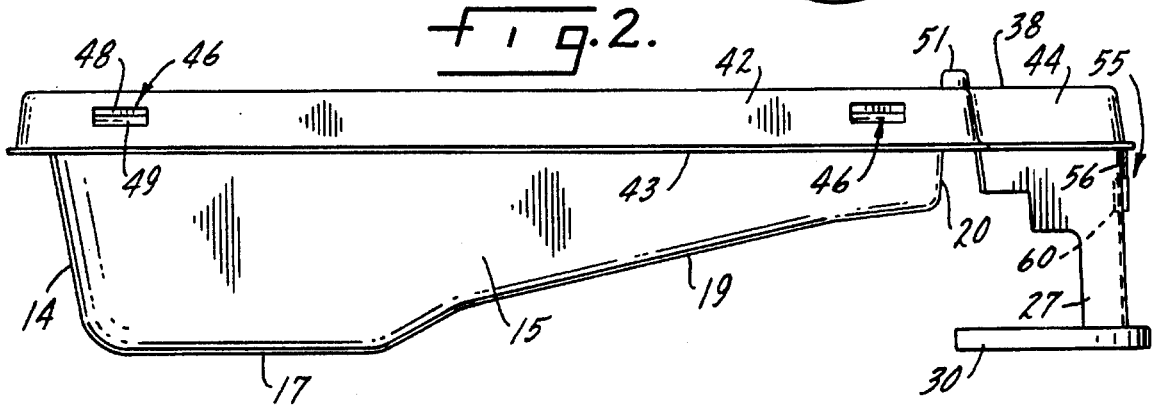

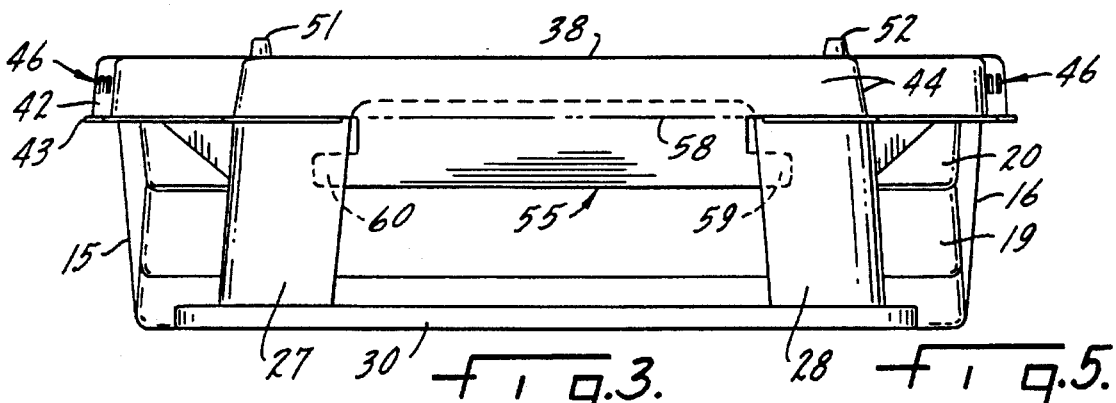
Fig.3.
Fig.5.
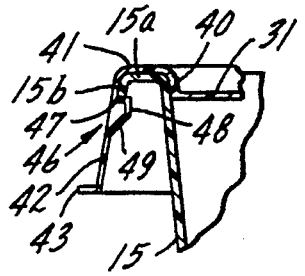
Fig.4.
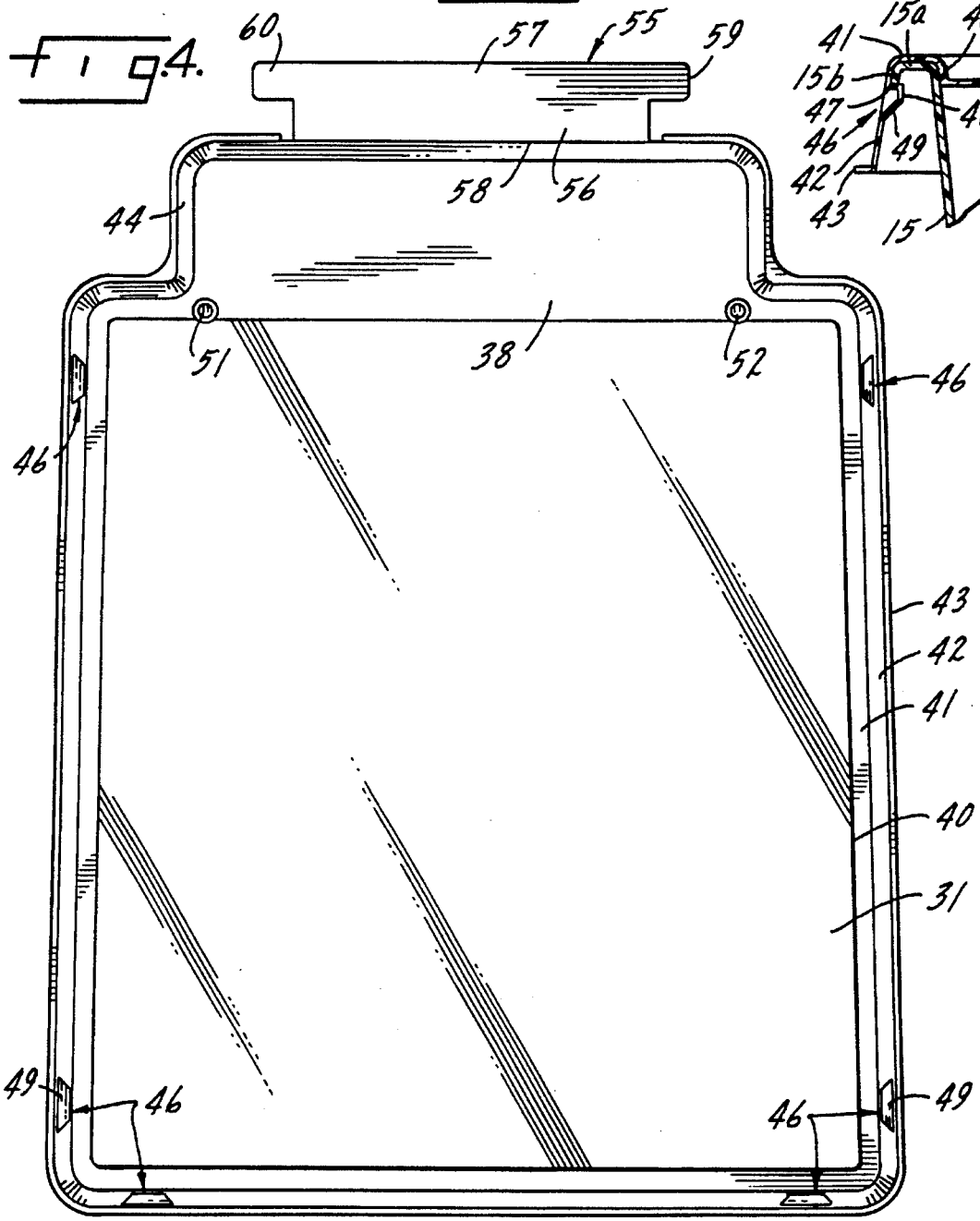

RESEALBLE PAINT TRAY

BACKGROUND OF THE INVENTION

This invention relates generally to coating accessories and, more specifically, to a combination wet coating storage container, dry coating storage container, and package assembly for coating applicators and coating material. For convenience of description, reference will hereafter be made to "paint" as representative generally of coating material.

Conventional roller painting equipment used by consumers or professionals almost invariably consists essentially only of a roller and a paint tray. A batch of paint from a one gallon or other convenient sized container of paint is poured into a paint tray which usually has a storage capacity considerably less than the volume of the paint container, and the roller is dipped into the tray as the work progresses until the batch is exhausted, at which time another batch is poured into the paint tray. It is always hoped that the paint in the tray will be exhausted at the same time as the person applying the paint quits for the day or leaves the job for an extended period of time so that a skin will not form on the paint left in the tray due to solvent evaporation, but quite often this does not happen. As a consequence the user has the option of pouring the unused paint back into the original container, which is invariably a messy process with the potential for spillage on a floor or carpeted surface, or leaving the unused paint in the tray until the user can return to finish the job. When the paint is left for even as short a time as a few hours the solvent evaporates and an undesirable skin forms on the surface of the paint. This skin must then be removed before painting is resumed. Removing the skin is an even messier task than pouring out the unused paint with all the above described disadvantages. In addition, due to solvent evaporation, the now skin free paint will often be thicker than when it was poured from the original container and, as a consequence, the surface cover ability and quality may consequently be lowered.

Attempts have been made to address the above disadvantages but none to our knowledge has been sufficiently successful to go into widespread commercial use. For example, a number of proposals have been made involving a mating cover for a paint tray but many, and possibly a majority, of said proposed structures attempt to make provision to also contain the roller in the closed space formed by the trayed and associated cover. Such a construction does however have inherent disadvantages in that all, or nearly all, paint trays include an inclined ramp near the rear thereof for the purpose of "rolling out" or distributing a fresh roller load of paint after dipping into the paint pool so that the paint is evenly distributed on the roller prior to application to a receiving surface. The surface of the inclined ramp becomes coated with wet and sticky paint during use and hence if the brush handle is laid thereon preparatory to closing the cover on the tray, the handle becomes sticky and unusable thereby requiring cleaning prior to recommencing use. To overcome this drawback additional structure has been proposed to hold the handle away from the wet ramp. While such an arrangement may be functional, the resultant structure is impractical in that, by and large, the lid and/or tray, and particularly the lid, may not then be manufactured by the conventional thermoform process due to the structural complexity of the structure. As is well-known, in the current market environment which demands low cost products using minimal raw material and manufacture by conventional mass manufacturing techniques to produce a low cost product in today's highly competitive marketplace, such complicated structure cannot meet current market requirements.

In addition to the foregoing requirements a paint tray assembly consisting of a paint tray and lid must occupy a minimal cubic space for manufacturing, shipping and displaying purposes. Closed tray assemblies have been proposed which are not constructed so as to contain a roller but almost invariably they are bulky and consume far too much space in the manufacturing, shipping and/or displaying process to be economically feasible. The fact that an inclined ramp is a necessity further complicates the provision of a satisfactory tray assembly which does not include applicator retention capacity. In fact, the additional bulk resulting from such constructions clearly prevents successful commercial utilization due to the required low cost nature of the product, a disadvantage which is compounded when a lid is hinged to a tray. In effect, the trays should be nestable, the lids should be nestable, at least with respect to one another, and a plurality of lids should add only a minute fraction of bulk to an equal number of trays so that manufacturing, shipping and displaying steps may be carried out at the lowest possible cost and least inconvenience.

It is also a requirement of a commercially practical tray assembly that the assembly function as a package so as to provide the option of combining the tray assembly, either without redesign, or at least without substantial redesign, with an appropriate paint applicator such as a pad, so that a paint kit is formed.

In addition to functioning as a paint kit the tray assembly, whether offered to the ultimate consumer as a tray assembly or as a paint kit, should also function as a package. In this connection the lid should have a wide, flat area both on its upper and lower surfaces to accommodate labels and other externally applied point of purchase marketing aids which assist in the selling potential of the tray assembly. If the lid is made from a clear plastic material a label on the underside of the lid will present the product for sale and, by turning over the lid, will provide use instructions.

SUMMARY OF THE INVENTION

The invention is a tray assembly composed of a paint tray and a matching lid which, when assembled, forms a sealed container effective to maintain paint or other coating material in a stable condition for up to a week; that is, for an extended period of time without a skin forming on the paint. The tray has an inclined ramp which blends smoothly into a paint reservoir so that clean up of the tray at the end of a use, or in preparation for an immediately succeeding use requiring a different paint color, is quick and easy with no possibility of color carry-over. The seal feature is formed by a plurality of inwardly directed projections on the peripheral edge of the lid so positioned that when the lid is brought downwardly into contact with the upper peripheral edge of the tray, the lid projections snap under the upper rim of the tray and draw the lid into tight sealing engagement with the tray. In addition, the tray assembly has a supplemental locking feature utilizing a pair of tabs which fold inwardly when assembled to the tray to further secure the lid to the tray.

The invention further includes a tray assembly having the features above described in combination with an internal applicator rest for maintaining a supplemental applicator, such as a brush or pad, out of contact with the main body of the tray during periods of roller usage.

The lid portion of the invention is adaptable for manufacture by the thermoform process whereby minimal material and forming costs are incurred in the manufacturing process. In addition, the lid and tray are so constructed that like parts nest within one another to thereby realize maximum savings in shipping and handling costs which further contribute to the overall economy of manufacture.

And finally, the invention includes a flat lid surface extending over substantially the maximum physically available area so that labeling is facilitated, including not only original labeling but subsequent revisions.

Other advantageous features of the invention will become apparent from the following description of the invention.

BRIEF DESCRIPTION OF THE DRAWING

The invention is illustrated more or less diagrammatically in the accompanying drawing in which:

FIG. 1 is an exploded view of the resealable tray assembly of the invention;

FIG. 2 is a side view of the resealable tray assembly showing the lid in sealing engagement with the tray;

FIG. 3 is a right end view of the tray as shown in FIG. 2;

FIG. 4 is a bottom plan view of the lid; and

FIG. 5 is a detail view showing the means for forming sealing engagement between the lid and tray, this Figure being shown to an enlarged scale as compared to the other Figures.

DESCRIPTION OF A SPECIFIC EMBODIMENT

Like reference numerals will be used to refer to like or similar parts from Figure to Figure in the following description of the drawing.

Referring first to FIG. 1 the resealable paint tray assembly of the invention is indicated generally at 10. The tray assembly 10 includes a tray, indicated generally at 11, and a lid, indicated generally at 12. In FIG. 1 the lid and tray are shown in an unassembled, exploded condition whereas in FIGS. 2, 3 and 5 the lid and tray are shown assembled.

Tray 11 includes front wall 14, left wall 15, right wall 16 and bottom wall 17. The rear end of the tray is composed of a number of elements including inclined ramp 19, the forward portion at least of which functions as a portion of the bottom of the tray as well as partially closing off the rear end. A generally vertically disposed portion of the rear wall is indicated at 20, said wall portion 20 flanking a brush rest section indicated generally at 21. Brush rest section 21 includes left and right inclined sides 22, 23 which join a flat bottom 24. The rear ends of left and right inclined sides 22, 23 and bottom 24 terminate at rearmost wall 25. Thus inclined walls 22, 23, bottom 24 and rearmost wall 25 form the enclosing vertical portion of the rear end of the tray not formed by vertical rear wall portion 20. A pair of legs are indicated at 27, 28 which terminate in a generally U-shaped connector 30, the legs 27, 28 and connector 30 being contoured to fit a ladder tray in use in a conventional manner as will be apparent from FIGS. 1 and 2.

The upper peripheral edge of front wall 14, left and right side walls 15, 16, rear wall 20 and the uppermost edge portions of brush rest section 21 are respectively formed by an outwardly directed flange means having horizontal flange portions 14*a*, 15*a*, 16*a*, 20*a* and 21*a*, all of which in this instance lie in a common plane. Flange portions 14*a*, 15*a*, 16*a*, 20*a* and 21*a* all terminate in a downturned lip 14*b*, 15*b*, 16*b*, 20*b* and 21*b* respectively. It will be noted that lips 14*b*, 15*b* and 16*b* extend downwardly a uniform distance which may, for example, be on the order of about ⅛". lips 20*b* and 21*b* extend downwardly a substantially greater distance in order to provide additional structural edge rigidity. It will be noted that lip 21*b*, provides structural edge rigidity and also forms a portion of the legs 27, 28. A pair of projections are indicated at 32, 33 extending upwardly from the peripheral flange 20*a* to form a stop or abutment which prevents a paintbrush which is resting in brush rest section 21 from sliding into the active paint reservoir formed by bottom 17, the side walls, and inclined ramp 19.

Lid 12 includes a rectangular flat plate 31 whose edges blend smoothly into a peripheral edge rib consisting of a front portion, indicated generally at 34, left and right side portions, indicated generally at 35, 36 respectively, and a rear portion, indicated generally at 37. It will noted that the uppermost flat surface of the central section 38 of rear portion 37 extends outwardly a distance sufficient to overlie the brush rest section 21.

The contour of the front, left, right and rear portions of the lid rib is shown best in FIG. 5. The central plate 31 terminates at an upwardly and slightly outwardly inclined boundary wall 40 which, at its upper edge, blends smoothly into a flat wall 41, which in turn blends smoothly into downwardly and slightly outwardly extending enclosing wall 42. Preferably an outwardly directed lip 43 encircles the entire periphery of the lower edge of the enclosing wall to assist the user in grasping the lid to lift it off and place it on the tray.

As best seen in FIGS. 1, 4 and, particularly, 5, a plurality of locking lugs, indicated generally at 46, are located along the front, left and right sides of the tray lid, preferably at least two per wall. As best seen in FIGS. 4 and 5 each locking lug 46 includes a generally flat upper, trapezoidal shaped wall 47, an inner wall 48, and a downwardly and outwardly inclined generally trapezoidally shaped bottom wall 49. As best seen in FIG. 5 the generally flat upper wall 47 is located so as to snap under the lower edge of downturned lip 15*b*. Preferably said wall 47 has a very slight downward taper to assist the snap connection of locking lug 46 to lip 15*b*. Each of the other locking lugs is similarly contoured. A pair of abutment housings are indicated at 51, 52 to fit over the brush abutment projections 32, 33 on tray 11.

The outwardly extending central portion 38 of the lid is defined by a continuation 44 of downwardly and slightly outwardly extending wall 42 as best seen in FIGS. 1, 2 and 3. A lid locking tab is indicated generally at 55 extending outwardly from the wall 42 at its lower edge. Lid locking tab 55 is generally T-shaped, and consists of a wide stem section 56 and a crossbar section 57. The junction between the lower edge of wall 42 and the base of stem portion 56 functions as a hinge which pivots about an axis indicated at 58. The lid locking tab 55 is shown in an as-molded condition in FIGS. 1 and 4, and in an assembled condition in FIGS. 2 and 3. From FIGS. 2 and 3 it will be noted that after the lid 12 is brought down into engagement with the tray 11 and locked and sealed thereto by the action of the locking lugs 46 snapping into the locked position of FIG. 5, the end 60 of the crossbar 57 is manually bent inwardly, as viewed in FIG. 2, so that said crossbar end 60 snaps into place behind leg 27 as best seen in FIG. 3, but also in FIG. 2. End 59 is likewise snapped into a secured, locked position behind leg 28.

From the foregoing description it will be noted that a sealable and releasable; i.e.: a resealable, paint tray assembly has been provided which forms a closed container for handling raw paint for extended periods of time, up to a week or more, without the formation of a skin or other degradation of the paint, said sealing and resealing functions being accomplished by the snap engagement of the plurality of locking lugs 46 on the lid which engage under lowermost edge of downturned lips 14*b*, 15*b*, 16*b* and, if desired though not shown, 20*b* and 21*b* of the tray 11. In lieu of the use of locking lugs, the tab connectors 59, 60 may be used at the rear end of the tray.

By forming the lid, at least, of a clear plastic, such as RPET, the tray assembly can be used as a container for holding painting accessories at the point of purchase, thereby displaying the internal components for direct observation by the ultimate purchaser. It should be noted that such material is recyclable, has possibly the best solvent resistance of any of the commercially available plastics today, and high impact resistance as well as high tear resistance.

The lid is resealable for the lifetime of the tray, eliminates packaging disposal since the tray assembly functions as a package, is reusable many times since there are no nooks or crannies to trap paint which would preclude re-use with a different paint color, can be used as a dry storage container for paint brushes and sundry items at any stage of its life cycle, provides storage for wet roller covers and paint overnight to prevent dry out which would otherwise occur during long periods of nonuse between periods of use, is fully recyclable, and permits easy label packaging changes as compared to converting conventional packaging material. It should also be noted that the separated inverted lid can be used to rest wet brushes, rollers, etc. on during periods of use since the substantial depth of the lid rib enclosing wall 42 precludes roll-off of objects placed on the upwardly facing inside surface of the lid. In addition to all of the above characteristics a single lid and tray occupy a bare minimum of space since the height of the lid above the tray, when assembled, amounts to no more than the thickness of the material from which the lid is formed which may, for example, be on the order of about 0.015".

Although a specific embodiment of the invention has been illustrated and described it will be appreciated from the foregoing description that modifications may be made without departing from the spirit and scope of the invention. Accordingly it is intended that the scope of the invention be limited solely by the scope of the hereafter appended claims when interpreted in light of the relevant prior art, and not by limitations set out in the foregoing specification.

We claim:

1. A combination storage container, dry paint roller storage container, and package assembly for paint rollers and coating material, said combination container and package assembly including a two part, resealable paint tray assembly for storing paint for extended periods of time without formation of skin, said paint tray assembly including a paint tray having bottom portion, a front portion, a rear portion and side portions, said paint tray having flange means extending substantially about its entire periphery, said bottom portion consisting of a bottom wall at the front portion of the tray and a ramp which extends upwardly from the bottom wall to the rear portion of the tray, said flange means including, as its uppermost portion, an outwardly extending generally horizontal flange portion of substantially constant thickness, said generally horizontal flange portion terminating, at its periphery, in a generally downwardly directed wall, said flange portion extending throughout substantially the entire peripheral extent of the flange means, a shallow lid, said lid being separate from the tray and having a contour which coincides with the contour of the paint tray, said lid further having a rib extending substantially about its entire periphery, said lid rib having as its uppermost portion, an outwardly extending generally horizontal planar portion of substantially constant thickness, said planar portion terminating, at its periphery, in a generally downwardly directed wall which coincides with the contour of the flange means on the tray, whereby the generally outwardly extending portion of the flange means and the lid fib, and the generally downwardly directed wall of the flange means and the rib are in surface abutting, sealing contact with one another throughout their entire area of abutting contact with one another, said lid having a smooth uninterrupted surface in an enclosed area formed by the lid rib, and means for locking the lid rib to the flange means of the tray, and thereby the lid to the tray, in sealing relationship at separate, spaced locations at least on each side portion of the tray assembly.

2. The combination container and package assembly of claim 1 further characterized in that the lids of a plurality of lid assemblies are nestable one within another, and the trays of a plurality of tray assemblies are nestable one within another.

3. The combination container and package assembly of claim 2 further characterized in that the locking means includes a plurality of inwardly projecting projections carried by the lid which engage the flange means of the side portions of the tray.

4. The combination container and package assembly of claim 3 further including brush rest means formed on the tray which precludes a brush, when placed therein, from sliding into a coating reservoir formed in the tray.

5. The combination container and package assembly of claim 4 further characterized in that the lid is formed from material of a substantially uniform thickness throughout, and the tray is formed from material of a substantially uniform thickness throughout.

6. The combination container and package assembly of claim 5 further characterized in that the lid, is formed from clear plastic whereby, when functioning as a package containing a paint applicator, the paint applicator is visible through the lid.

7. The combination container and package assembly of claim 6 further characterized in that the thickness of the material from which the lid is formed is on the order of about 0.015".

8. The combination container and package assembly of claim 1 further characterized in that the means for locking the lid rib to the flange means is a plurality of locking lugs on the lid rib which underlie the peripheral edge of the flange means.

9. The combination container and package assembly of claim 1 further characterized in that the lid, is formed from clear plastic whereby, when functioning as a package containing a paint applicator, the paint applicator is visible through the lid.

10. A two part, reseatable paint tray assembly for storing paint for extended periods of time without formation of skin, said paint tray assembly including a paint tray having a front portion, a rear portion and side portions, said paint tray having flange means extending substantially about its entire periphery, said flange means including a generally downwardly directed wall throughout substantially the entire peripheral extent of the flange means, a lid, said lid being separate from the tray and having a contour which coincides with the contour of the paint tray, said lid further having a rib extending substantially about its entire periphery, said lid rib having a contour which coincides with the contour of the flange means on the tray, said lid having a smooth uninterrupted surface in an enclosed area formed by the lid rib, and means for locking the lid rib to the flange means of the tray, and thereby the lid to the tray, in sealing relationship at one location at least on each side portion of the tray assembly, the lids of a plurality of lid assemblies being nestable one within another, and The trays of a plurality of tray assemblies are nestable one within another, the locking means includes inwardly projecting projections earned by the lid which engage the flange means of the side portions of the tray, the locking means further including a planar projecting portion extending outwardly from a rear edge of the lid rib, said planar projecting portion being bendable downwardly and inwardly into locking engagement with the rear portion of the tray.

11. The two part, resealable paint tray assembly of claim 10 further characterized in that the tray includes a paint reservoir and brush rest section capable of holding a brush out of contact with the paint in the paint reservoir during periods of use of the tray assembly.

12. The two part, resealable paint tray assembly of claim 11 further characterized in that the lid is formed from plastic.

13. The two part, resealable paint tray assembly of claims 12 further characterized in that the lid is formed of recyclable RPET.

* * * * *